United States Patent [19]

Gerch

[11] 4,354,542

[45] Oct. 19, 1982

[54] HANDBAG

[75] Inventor: Edward L. Gerch, Chicago, Ill.

[73] Assignee: Kingport, Ltd., Evanston, Ill.

[21] Appl. No.: 227,987

[22] Filed: Jan. 23, 1981

[51] Int. Cl.[3] ..... A45C 13/40

[52] U.S. Cl. ..... 150/34; 150/30; 190/52

[58] Field of Search ..... 150/28 R, 30, 34; 190/52, 51

[56] References Cited

U.S. PATENT DOCUMENTS

| | | | |
|---|---|---|---|
| 2,533,850 | 12/1950 | Syracuse | 190/52 |
| 2,597,194 | 5/1952 | Sholl | 150/34 |
| 2,609,897 | 9/1952 | Meyer | 190/52 |
| 2,616,471 | 11/1952 | Feigl et al. | 150/34 |
| 2,801,666 | 8/1957 | Steele | 190/51 X |
| 3,110,333 | 11/1963 | Stember | 150/30 |
| 3,202,191 | 8/1965 | Kaplan | 150/30 |
| 3,870,132 | 3/1975 | Hanley | 190/52 |
| 4,078,595 | 3/1978 | Mittelmann | 150/30 |
| 4,171,011 | 10/1979 | Kopin | 150/34 |

FOREIGN PATENT DOCUMENTS

| | | | |
|---|---|---|---|
| 2026852 | 2/1980 | United Kingdom | 190/52 |

*Primary Examiner*—William Price
*Assistant Examiner*—Gary E. Elkins
*Attorney, Agent, or Firm*—Kegan, Kegan & Berkman

[57] ABSTRACT

Improvements in a handbag or the like are disclosed which include an additional umbrella compartment adjacent the bottom of the bag being accessible through an opening in the bottom surface of the bag. The additional, out-of-the-way compartment is formed inside the handbag in soft-sided fashion, i.e., without the need for a rigid tubular compartment being added to the bag. Access to the compartment is obtained through a selectively closable opening positioned longitudinally along the bottom surface of the handbag. The opening may further extend partly up one or more of the end surfaces of the bag.

6 Claims, 4 Drawing Figures

FIG. 4

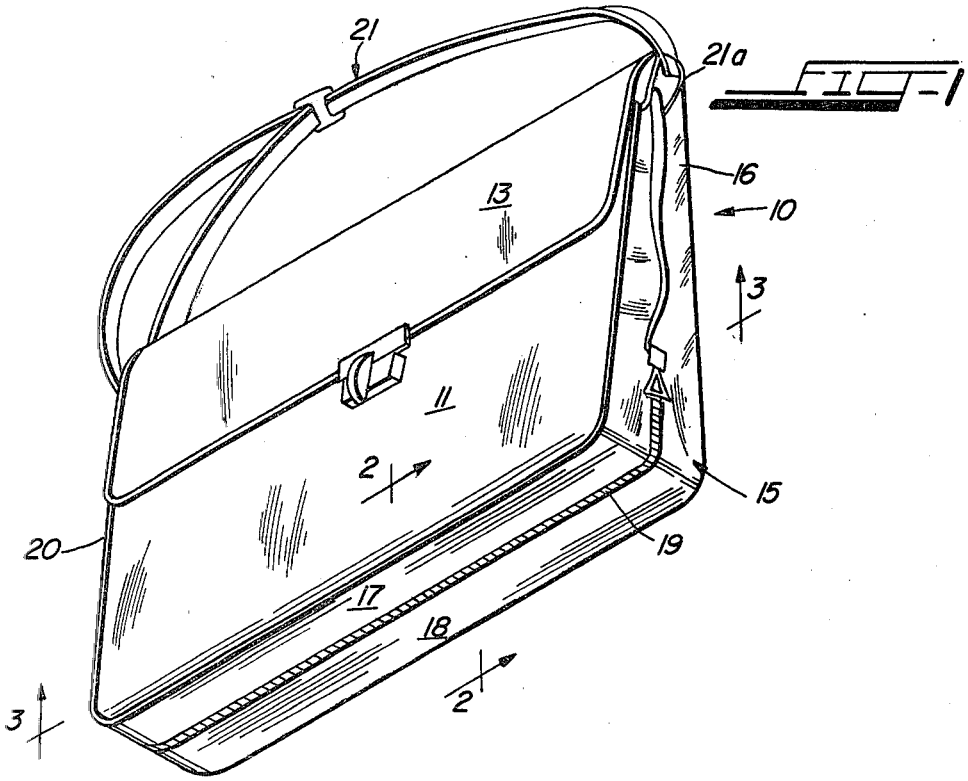
FIG-1
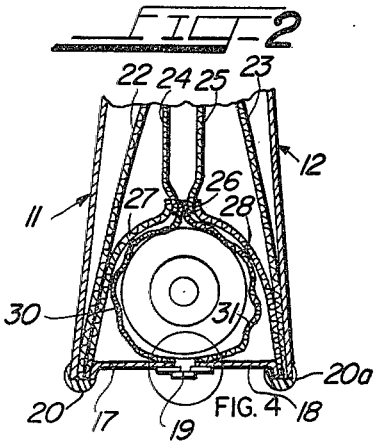
FIG-2
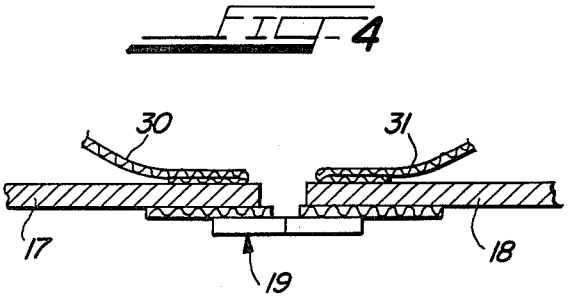
FIG-4
FIG. 4
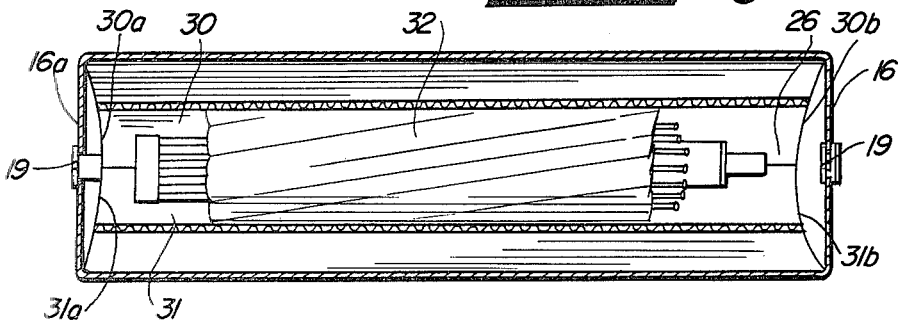
FIG-3

HANDBAG

BACKGROUND OF THE INVENTION

The present invention relates in general to baggage or travel accessories, and more particularly, to an over-the-shoulder handbag, tote bag, brief case, or the like.

Handbags have long been traditional fashion accessories and capable of or adapted to retain a collapsible umbrella therein. The following patents disclose handbags or brief cases adapted for having foldable umbrellas positioned therein or attached thereto: U.S. Pat. Nos. 1,783,275; 1,895,744; 1,958,003; 2,369,943; and 2,394,332. U.S. Pat. No. 2,533,850 discloses a handbag having a pair of opposed independently accessible side pockets suitable for positioning baby bottles therein.

However, all of the above-identified patents having umbrella pockets in connection with baggage, disclose a compartment only through the side of the handbag or briefcase rather than through the bottom surface thereof. The same is true of the patent disclosing the handbag for carrying baby bottles. Furthermore, the use, in most of these patents, of a rigid tubular umbrella mounting member having one or two small circular access openings actually restricts the ability of a user to insert an umbrella into its compartment.

Accordingly, it is a general object of the present invention to provide a new and improved handbag, briefcase, or the like, including therein a selectably closeable compartment having access thereto through at least the bottom surface of the bag for providing improved ease of mounting an umbrella therein or removing same therefrom.

SUMMARY OF THE INVENTION

The invention is directed in a handbag of the type having a primary compartment which is user accessible through the top of the handbag, to an improvement wherein the bag includes a secondary compartment which is user accessible through the bottom surface thereof.

The invention is further directed in a handbag of the type including opposed front and back side walls connected along at least a portion of their periphery by a narrow elongate web defining a bottom surface and opposed end walls of the handbag. A portion of the periphery of the walls define a primary opening on the handbag for providing access to a primary compartment therein. Means are included for closing a primary opening on the handbag positioned adjacent the top thereof and means are provided for carrying the bag. The improvement comprises a secondary compartment in the handbag positioned adjacent the bottom thereof and includes an elongate secondary opening on the bottom surface which is oriented longitudinally therealong for providing user access thereto. The improvement further includes means on the bottom surface adjacent the secondary opening for providing selective closing of same.

BRIEF DESCRIPTION OF THE DRAWINGS

The features of the present invention, which are believed to be novel, are set forth with particularity in the appended claims. The invention may best be understood from the following detailed description of a currently preferred embodiment thereof, taken in conjunction with the accompanying drawings, wherein:

FIG. 1 is a perspective view of a handbag constructed in accordance with the present invention showing the bottom surface thereof and the longitudinally oriented umbrella compartment opening positioned thereacross.

FIG. 2 is a fragmentary cross-sectional view taken along lines 2—2 of FIG. 1.

FIG. 3 is a fragmentary cross-sectional view of the handbag taken along line 3—3 of FIG. 1.

FIG. 4 is an enlarged view of a detail from FIG. 2 showing the umbrella compartment opening and slide fastener therefore in cross-section.

DESCRIPTION OF THE PREFERRED EMBODIMENT

Referring to FIGS. 1–4, a preferred embodiment of a handbag constructed in accordance with the present invention is generally indicated at 10 and includes front and back outer panels 11 and 12, respectively, a top flap or closure member extending from the back panel to fold over the top portion of front panel 11 and be secured thereto by a fastener 14. The front and back panels 11 and 12 are connected around a substantial portion of their periphery (bottom and sides) by a narrow elongate web, generally indicated at 15, which defines the sidewalls or panels 16, **16*a* and bifurcated bottom panels 17–18. The bottom panels are joined by a slide fastener 19 which, in this embodiment, also extends partially up both side walls. Conventional piping 20, 20*a* is added to the joinder between the respective panels for enhancing the appearance of the bag. For ease of user carrying, an adjustable over-the-shoulder strap 21 is retained by a pair of loops (only 21*a*** shown) fastened adjacent the top of the opposing side panels.

As shown most clearly in FIG. 2, this embodiment of the present invention includes several interior compartments defined by a front pocket interior wall 22, a back pocket interior wall 23, and central pocket walls 24, 25, which are joined at the bottom at a common joinder 26. In this embodiment, the interior compartments which are accessible through the top of the handbag, and enclosed by flap 13, are separated from the umbrella compartment, to be discussed in greater detail below, by a pair of bottom walls 27, 28 which are also connected at common joinder 26 and extend to the opposed bottom peripheries of front panel 11 and back panel 12. The inner central compartment, which is shown most clearly in FIG. 2 and defined by sidewalls 24 and 25, is closed at the top thereof by an interior slide fastener (not shown) in traditional manner.

The outer panels of the present embodiment are preferably formed of vinyl, leather, or the like, and the interior walls thereof are preferably formed of nylon, silk or the like, both of which may be reinforced to suit the user.

An important aspect of the present invention is the construction of a separate umbrella compartment in the bottom of handbag 10 which is detectable from the outside of the bag solely by slide fastener 19, and defined inside the handbag by opposing walls 30, 31 which are joined at their upper ends at joinder 26 and have their bottom ends fastened adjacent the interior abutting edges of bottom panels 17, 18, respectively (as shown most clearly in FIG. 4).

Referring to FIGS. 2 and 3, the umbrella compartment is completely defined by side walls 30 and 31, and fastener 19. The sidewalls are pleated at **30*a*, 30*b* and 30*a*, 31*b* to fold around the ends of an umbrella 32. The compartment extends the length or substantially the length of handbag 10, a distance which is longer than the length (13 inches in the preferred embodiment), of a folded umbrella 32 (approximately 11 inches). The slide fastener 19 preferably extends not only the length of bottom walls 17–18, but also extends partly up each of the side walls 16–16***a* to the height of interior joinder 26 (approximately 2½ inches). Therefore, with the slide fastener opened along its entire length, the zippered opening of the umbrella compartment defines three of the four sides forming a vertical or elevational periphery of that compartment, thus making the positioning of an umbrella therein, or the removal of same, extremely easy and efficient compared to umbrella compartments heretofore known in the art.

An additional aspect of the present invention relates to the improved aesthic qualities of the handbag obtained by making the slide fastener the sole visible outward distinction between the instant handbag and a comparable bag without such an umbrella compartment. In this connection, the slide fastener should be colored similarly to the color of bottom panels 17, 18. With the umbrella inserted into its compartment, and slide fastener 19 completely closed, handbag 10 maintains a traditional softsided appearance, as the umbrella compartment is not formed of a hard tubular material as such compartments were formed of heretofore.

Thus, an improved handbag, tote bag, or briefcase has been shown and described which includes therein a secondary umbrella compartment having access thereto through the bottom of the bag. The bag is a more functionally efficient and cosmetically appealing accessory than previously known in the art.

While one embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention.

What is claimed is as follows:

1. In a handbag of the type including opposed front and back side walls connected along at least a portion of their periphery by a narrow elongate web defining a bottom surface and opposed end walls of said handbag, a portion of the said periphery of walls defining a primary opening adjacent a top of said handbag for providing access to a primary compartment extending inwardly of said handbag from said primary opening therein, means for closing said primary opening on said handbag positioned adjacent the top thereof, and means for carrying said bag;

an improvement comprising a secondary compartment in said handbag positioned adjacent the bottom thereof and extending inwardly into said handbag and including an elongate secondary opening on said bottom surface oriented longitudinally therealong for providing user access thereto, means on said bottom surface adjacent said secondary opening for providing selective closing of same, and common joinder means between a portion of said primary compartment and a portion of said secondary compartment for maintaining said secondary compartment within said handbag.

2. The handbag as defined in claim 1 wherein said secondary opening closure means includes a slide fastener.

3. The handbag as defined in claim 2 wherein said secondary opening closure means includes a slide fastener and a slide on said slide fastener being adjacent a distal end of said openng on said one side wall when said slide fastener is in closed condition.

4. The handbag as defined in claim 1 wherein said secondary opening extends partly up at least one end wall of said handbag and said common joinder is positioned longitudinally across an interior of said handbag adjacent an upper end of said opening on said end wall.

5. The handbag as defined in claim 1 wherein said means for carrying said handbag includes a strap adaptable for over the shoulder type use.

6. In a handbag of the type including opposed front and back side walls connected along at least a portion of their periphery by a narrow elongate web defining a bottom surface and opposed end walls of said handbag, a portion of the said periphery of walls defining a primary opening adjacent a top of said handbag for providing access to a primary compartment therein, said primary compartment extending downwardly from the top of said handbag, means for closing said primary opening on said handbag positioned adjacent the top thereof, and means for carrying said bag;

an improvement comprising a secondary compartment in said handbag positioned to extend upwardly from the bottom thereof and including an elongate secondary opening on said bottom surface oriented longitudinally therealong and extending partly up at least one of said end walls thereof for providing user access thereto, means on said bottom surface and at least one end wall adjacent said secondary opening for providing selective closing of same, said primary compartment including at least a sub-compartment longitudinally oriented therein, said sub-compartment and said secondary compartment including a common joinder affixedly positioned longitudinally across an interior of said handbag adjacent an upper end of said secondary opening partially up said end wall of said bag.

* * * * *